US007784886B2

(12) United States Patent
Ashby et al.

(10) Patent No.: US 7,784,886 B2
(45) Date of Patent: Aug. 31, 2010

(54) FILING CABINET WITH A LOCKING SYSTEM

(75) Inventors: Kevin Ashby, Innisfil (CA); David Parshad, Markham (CA); Ivan Liu, Markham (CA)

(73) Assignee: Inscape Corporation, Holland Landing, Ontario (CA)

( * ) Notice: Subject to any disclaimer, the term of this patent is extended or adjusted under 35 U.S.C. 154(b) by 527 days.

(21) Appl. No.: 11/889,847

(22) Filed: Aug. 16, 2007

(65) Prior Publication Data

US 2008/0074016 A1 Mar. 27, 2008

Related U.S. Application Data

(63) Continuation-in-part of application No. 10/969,671, filed on Oct. 21, 2004, now abandoned.

(30) Foreign Application Priority Data

Jul. 28, 2004 (CA) ..... 2475835

(51) Int. Cl.
*E05B 65/46* (2006.01)

(52) U.S. Cl. ..... 312/216

(58) Field of Classification Search ..... 312/215, 312/216, 217, 219, 220, 222, 107.5, 295, 312/311

See application file for complete search history.

(56) References Cited

U.S. PATENT DOCUMENTS 490,099 A 1/1893 Bloomfield
944,513 A 12/1909 Selden
1,350,047 A 8/1920 Way
1,366,451 A 1/1921 Hawley
1,379,977 A 5/1921 Hamlin
1,379,999 A 5/1921 Marcinek
1,395,721 A 11/1921 Madison
1,409,707 A 3/1922 Grube
1,440,146 A 12/1922 Hawley
1,678,736 A * 7/1928 Ledin ..... 312/216
2,130,216 A 9/1938 Zaninovich
2,913,296 A 11/1959 Martin
3,002,800 A 10/1961 McMahan
3,189,392 A 6/1965 Mehlig, Jr. et al
3,752,518 A 8/1973 Cannell
3,893,740 A 7/1975 England
4,190,273 A 2/1980 Schaffrin
4,452,498 A 6/1984 Wood, Jr. et al.
4,455,846 A 6/1984 Wichinsky
4,480,883 A 11/1984 Young
4,545,150 A 10/1985 Williams
4,598,964 A 7/1986 Frink et al.
4,796,445 A 1/1989 Norden, Jr.
4,836,624 A 6/1989 Schwickrath
5,069,511 A 12/1991 Swets et al.
5,103,659 A 4/1992 Benefield
5,267,688 A 12/1993 Benefield
6,164,738 A 12/2000 Dane et al.
6,375,286 B1 4/2002 Miller et al.

* cited by examiner

*Primary Examiner*—James O Hansen
(74) *Attorney, Agent, or Firm*—Riches, McKenzie & Herbert LLP

(57) ABSTRACT

An external locking mechanism for a filing cabinet incorporating two hinged blocking plates at each side of the cabinet and a locking bar which is movable without removal from attachment to the cabinet to positions such that the blocking plates can be selectively prevented from being moved to unblocked positions or permitted to be moved to unblocked positions.

8 Claims, 5 Drawing Sheets

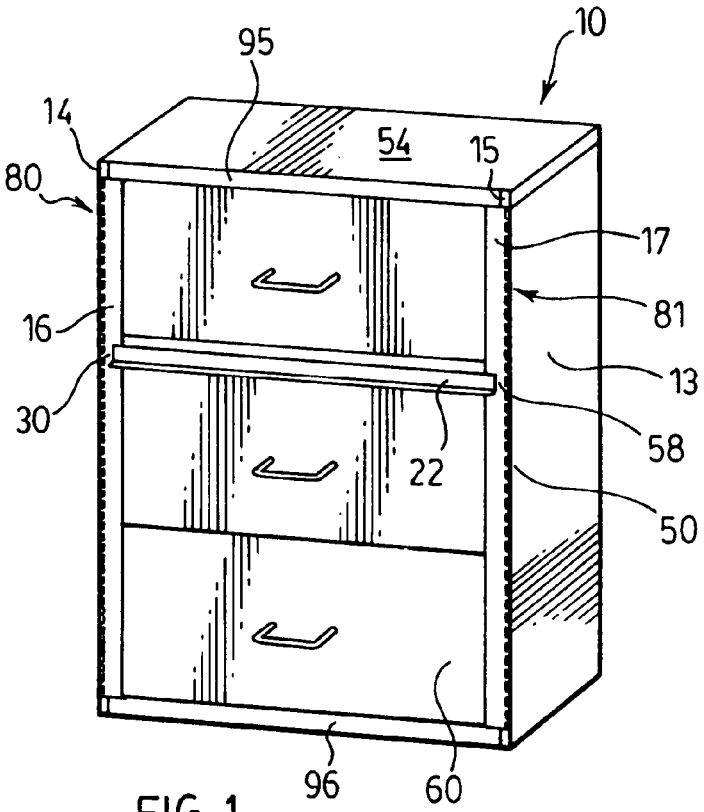
FIG. 1.
FIG. 2.
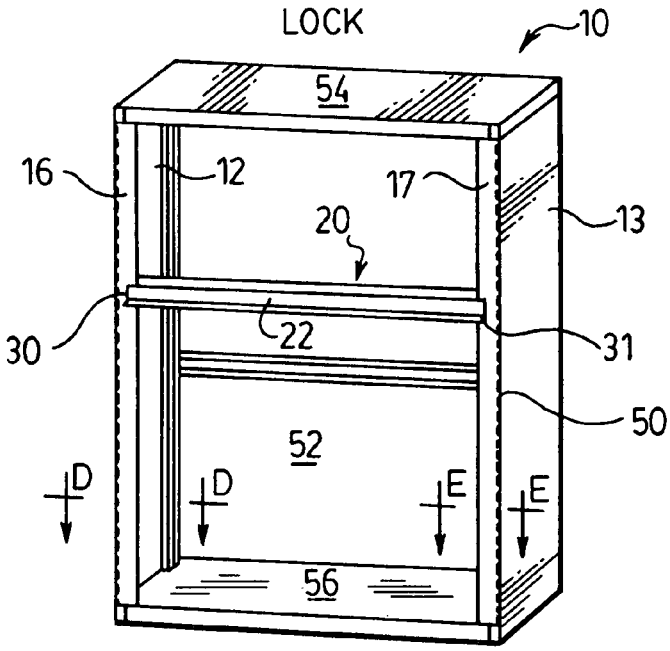

FILING CABINET WITH A LOCKING SYSTEM

RELATED APPLICATION

This application is a continuation-in-part of U.S. patent application Ser. No. 10/969,671 Oct. 21, 2004 now abn and claims the benefit of 35 U.S.C. 120.

SCOPE OF THE INVENTION

This invention relates to a filing cabinet, and in particular, to a filing cabinet with a locking system.

BACKGROUND OF THE INVENTION

Filing cabinets are known having drawers that open forwardly to provide access to paper files and the like inside. One example of a filing cabinet structure is shown in U.S. Pat. No. 4,480,883 to Edwards issued Nov. 6, 1984 which is directed to an internal anti-tip blocking device that permits only one drawer of a stacked column of drawers to be opened at any one time.

Filing cabinets are known to have internal lock structures which are internal of the cabinet and prevents any of the drawers from being opened. For added security, it is also known to provide external locking devices with a metal bar which extends vertically across the height of a column of drawers and is secured at the top and bottom of the cabinet to prevent opening of any drawers. Such external bar has the disadvantage that it must be removed and stored when not in use.

SUMMARY OF THE INVENTION

To at least partially overcome the disadvantages of previously known devices, the present invention provides an external locking mechanism for a filing cabinet incorporating two hinged blocking plates at each side of the cabinet and a locking bar which is movable without removal from attachment to the cabinet to positions such that the blocking plates can be selectively prevented from being moved to unblocked positions or permitted to be moved to unblocked positions.

An object of the present invention is to provide an improved external locking system for a filing cabinet.

Another object of the present invention is to provide a filing cabinet with a locking system which is very simple to use, and also relatively easy and inexpensive to manufacture.

In one aspect, the present invention provides a filing cabinet having a compartment with at least one drawer slidably mounted in the compartment between retracted and withdrawn positions. Blocking plates are hinged to each opposite side of the compartment rotatable on a vertical axis between: (i) a blocked position in the path of the drawer to prevent the drawer from withdrawal from the retracted position; and (ii) an unblocked position out of the path of the drawer to permit withdrawal to the withdrawn position. A locking bar is mounted to the cabinet movable between: (i) a locked position where at least a portion of the locking bar is in the path of both of the blocking plates and prevents each of the blocking plates from movement from the blocked position to the unblocked position; and (ii) unlocked positions where the locking bar is out of the path of the blocking plates and does not prevent the blocking plates from movement from the blocked position to the unblocked position.

In a preferred embodiment, the cabinet has a framework comprising by two opposite sidewalls, a back wall, a top wall, and a bottom wall which define a compartment therein containing sliding drawers and with an opening from the compartment from which the drawers are slidable through the opening.

The framework preferably includes a crossbeam which has ends that are secured to the opposite side walls of the framework preferably to extend horizontally between two drawers and with the locking bar mounted to the crossbeam, preferably for sliding or pivotal movement thereto.

The crossbeam preferably has a forward facing surface and the locking bar is mounted to the forward facing surface of the crossbeam. A locking bar is mounted to the crossbeam against removal from the crossbeam yet for movement such as sliding or pivoting relative thereto.

In one preferred embodiment, the two opposite side walls each have a forward facing surface. A continuous hinge is mounted to the forward facing surface of the side wall with one hinge plate of the continuous hinge forming or carrying blocking plate.

In another preferred embodiment, the two opposite side walls each have a forward facing gable surface and a continuous hinge is mounted to the gable panel with one hinge plate mounted flush with the gable surface and the other hinge plate of the piano hinge pivotable relative the fixed hinge plate and forming a blocking plate which extends inwardly in front of the drawers.

Preferably, the length of the locking bar is such that it does not extend past the two opposite side walls, regardless of the position of the locking bar.

In an alternative embodiment, the filing cabinet comprises two locking bars mounted at opposite sides of the compartment. Each of the two locking bars is movable between: (i) a locked position where at least a portion of the locking bar is in the path of one of the blocking plates and prevents the blocking plate from movement from the blocked position to the unblocked position; and (ii) an unlocked position where the locking bar is out of the path of the blocking plate and does not prevent the blocking plate from movement from the blocked position to the unblocked position.

BRIEF DESCRIPTION OF THE DRAWINGS

Further aspects and advantages will become apparent from the following description taken together with the accompanying drawings in which:

FIG. 1 is a front pictorial view of a filing cabinet in accordance with a first embodiment of the present invention showing the drawers closed and locked;

FIGS. 2 to 5 are front pictorial views of a filing cabinet in accordance with the first embodiment of the present invention, wherein the drawers and associated slides have been removed;

DESCRIPTION OF THE PREFERRED EMBODIMENTS

Reference is made to FIGS. 1 to 14 which illustrate a first embodiment of a filing cabinet in accordance with the present invention.

Figure 13:
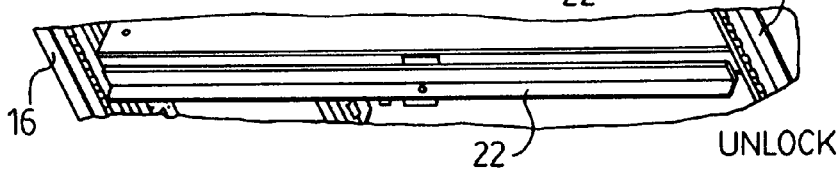
Figure 14:
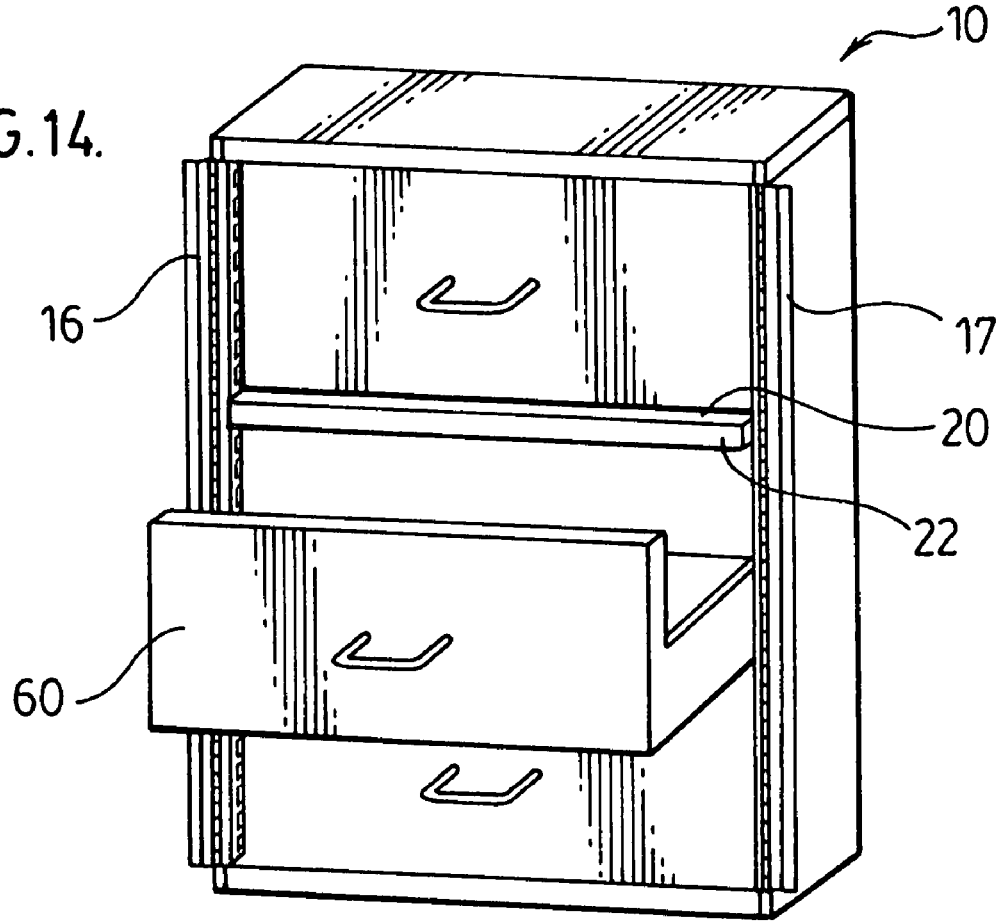
FIG. 14 is a front view similar to FIG. 1 but unlocked and with one drawer open.

As seen in FIGS. 1 to 14, the cabinet 10 has a framework comprising opposite side walls 12 and 13, a back wall 52, a top wall 54 and a bottom wall 56. The framework defines a compartment therein. As seen in FIGS. 1 and 14, three drawers 60 are mounted in the compartment for horizontal sliding between closed, retracted positions shown in FIG. 1 and open, extended positions. FIG. 14 shows a middle of the three vertically stacked drawers in an open, extended position. The drawers 60 are slidable on associated slides (not shown) mounted to the interior of the side walls 12 and 13 on each side of each drawer 60. The framework of the filing cabinet 10 includes a horizontal crossbeam 20. The crossbeam 20 has both of its ends permanently secured to the opposite side walls 12 and 13. The crossbeam 20 extends horizontally between the sidewalls 12 and 13 vertically between two of the drawers 60 and presents a forward facing surface 62 best seen in FIG. 24. Each of sidewalls 12 and 13 carry a forward facing gable surface 14 and 15 effectively forming a gable or post extending vertically beside each drawer 60 throughout the height of the cabinet.

FIGS. 2 to 13 illustrate the filing cabinet 10 of FIGS. 1 and 14 from which the drawers 60 and associated slides have been removed.

Figure 15:
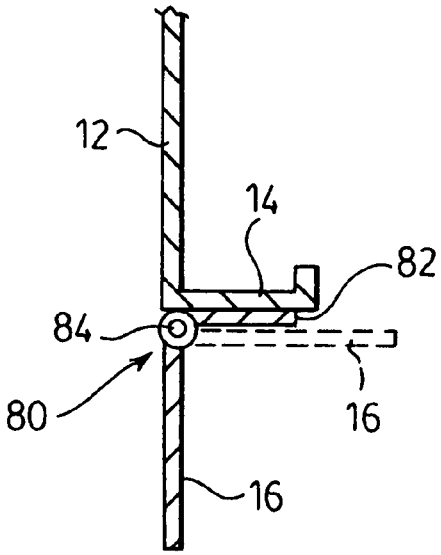
FIGS. 15 and 16 are cross-sectional plan views along section lines D-D' and E-E' in FIG. 2.
Figure 16:
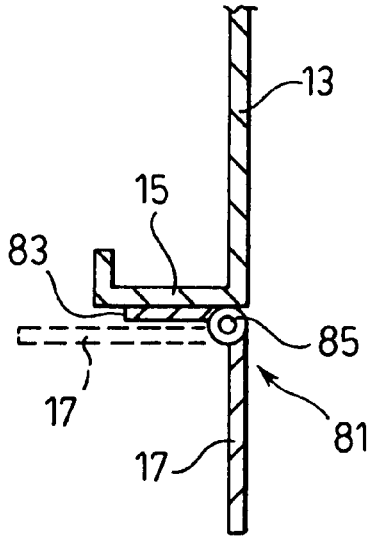

As seen in FIGS. 15 and 16, two continuous hinges 80 and 81 also known as piano hinges are mounted to the forward facing gable surface 14 and 15 of each side wall 12 and 13. Each hinge 80 and 81 has two hinge plates namely a base plate 82, 83, a blocking plate 16, 17 joined by a hinge pin 84, 85 with the base plate 82, 83 and blocking plate 16, 17 pivotable relative each other about the pin 84, 85. The base plate 82, 83 is fixedly secured to the respective gable surface 14 and 15 of the side walls as by screws, nuts, welding or the like with the hinge pin 84 disposed to not extend laterally beyond the respective side wall 12 and 13. Each blocking plate 16, 17 is thus hinged to its relative side wall 12, 13 for pivoting about the vertical hinge pin 84, 85.

Figure 5:
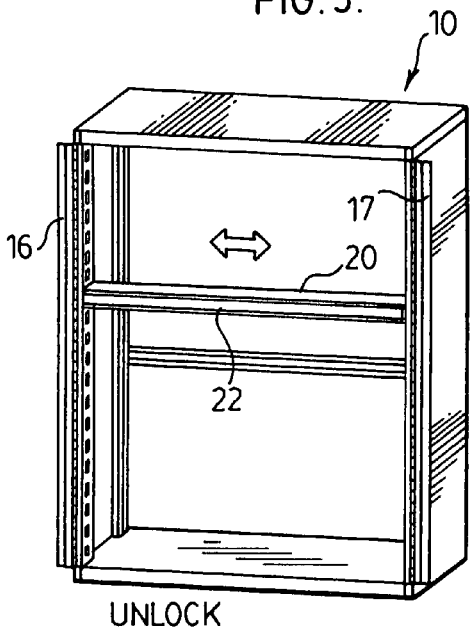
Figure 6:
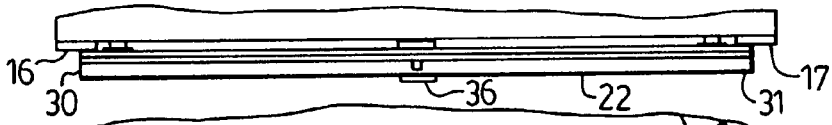
FIGS. 6, 8, 10 and 12 are partially cut-away top views of FIGS. 2 to 5, respectively.
Figure 7:
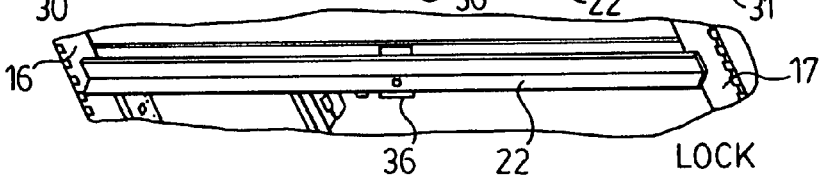
FIGS. 7, 9, 11, and 13 are partially cut-away front perspective views of FIGS. 2 to 5, respectively.
Figure 12:
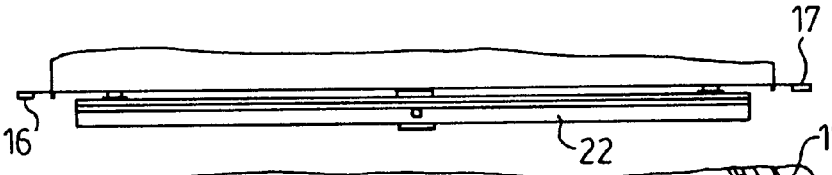

The blocking plates 16, 17 are adapted to be rotatable from: (i) a blocked position, as shown in FIGS. 2, 6 and 7, in which the blocking plates 16, 17 lie forward of the drawers 60 in the front plane of the front face of the cabinet 10 to (ii) an unblocked position, as shown in FIGS. 5, 12 and 13, in which the blocking plates 16, 17 are rotated to extend forwardly preferably perpendicular to the front face of the cabinet 10 and thus parallel to side walls 12 and 13. FIGS. 15 and 16 show the blocking plates 16, 17 in solid lines in an unblocked position and in dashed lines in a blocked position.

A locking bar 22 is slidably mounted to the forward facing surface 62 of the crossbeam 20 for sliding in the horizontal direction relative the crossbeam 20. The locking bar 22 is mounted to the crossbeam 20 against removal from the crossbeam 20. FIGS. 2, 6 and 7 show a middle locked position in which the locking bar 22 overlaps both of the blocking plates 16, 17 and prevents opening of the drawers. As seen in FIG. 6 which is a top view of FIG. 2, the left end 30 of the locking bar 22 is forward of the left blocking plate 16 and prevents its movement from the blocked position shown and the right end 31 of the locking bar 22 is forward of the right blocking plate 17 and prevents its movement from the blocked position.

Figure 3:
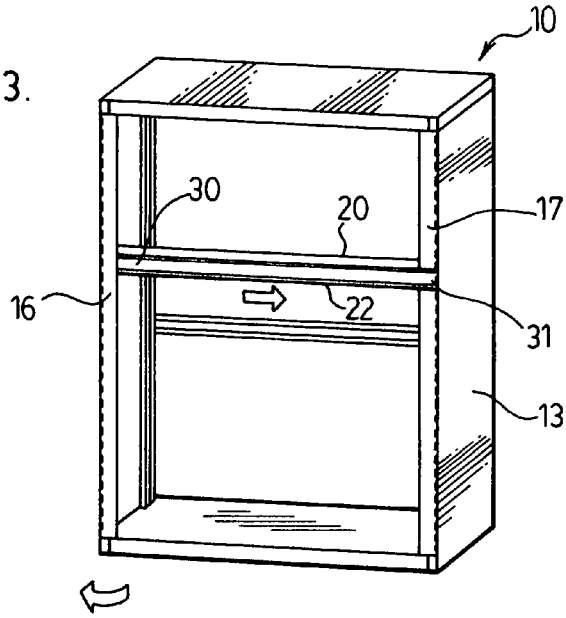
Figure 4:
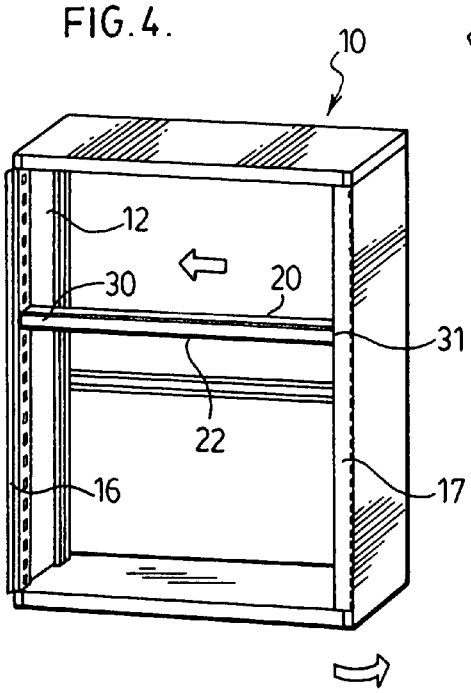
Figure 8:
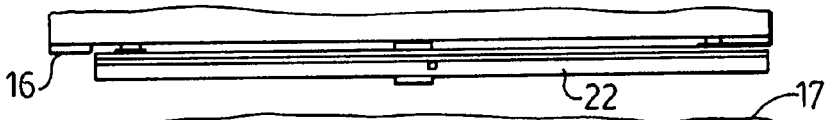
Figure 9:
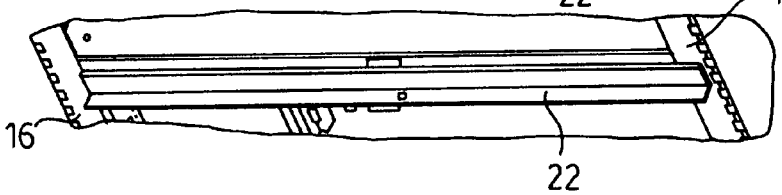
Figure 10:
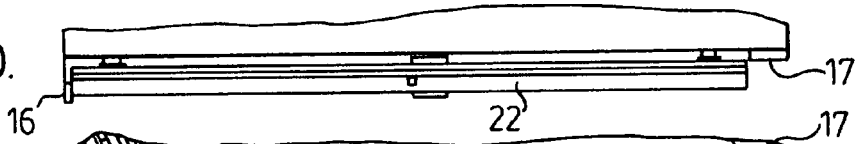
Figure 11:
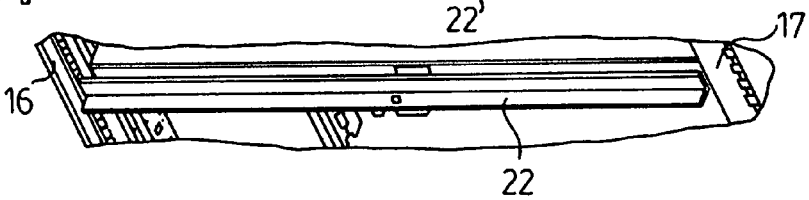

The locking bar 22 is slidable from the position shown in FIG. 2 to the right to the position shown in FIGS. 3, 8 and 9 such as to be clear of the blocking plate 16 thus allowing the blocking plate 16 to be rotated between the blocked and the unblocked position. FIGS. 4, 10 and 11 show a position which after the locking bar 16 has been rotated to the unblocked position, the locking bar 22 has been slid to the left to a position shown in FIG. 4 such as to be clear of blocking plate 17 thus allowing the blocking plate 17 to be rotated between the unblocked position and a blocked position. FIGS. 5, 12, 13 and 14 show a condition which from the position of FIG. 4, the blocking plate 17 is pivoted to the unblocked position and the locking bar 22 is slid back to the middle position. As seen in FIG. 12 in a top view the hinged blocking plates 16, 17 are in a position where they are out of the path of the drawers 60 and therefore, do not prevent the opening of the drawers 60, as shown in FIG. 29 with one drawer open.

The length of locking bar 22 is such that when it is slid to the right, as shown in FIG. 3, the left end 30 of the locking bar 22 is clear of the blocking plate 16 on the left side of the filing cabinet 10, and the right end 31 of the locking bar 22 does not extend past the edge of side wall 13. Similarly, when the locking bar 22 is slid to the left, as shown in FIG. 4, the right end 31 of the locking bar 22 is clear of the blocking plate 17 on the right side of the filing cabinet 10, and the left end 30 of the locking bar 22 does not extend past the edge of side wall 12. Therefore, the locking bar 22 is designed such that it does not extend laterally past vertical planes of the side walls 12 and 13 of the filing cabinet 10, and does not move into, for example, a wall adjacent the filing cabinet 10 or into the path of the drawers of any other filing cabinets which are adjacent to filing cabinet 10.

In the middle locked position of FIGS. 2, 6 and 7, the locking bar 22 is adapted to be fixed in the position to prevent movement of the locking bar 22. In this regard as best seen in FIGS. 6 and 7, a lock bracket 36 is secured to a central portion of the crossbeam 20 providing a horizontally extending flange with a vertical opening therethrough which is to align with vertical opening in the lock bar 22 such that a locking device such as a padlock may lock the locking bar 22 to the crossbeam 20 against movement. The locking bar 22 shown in FIGS. 1 to 13 has a L-shaped in cross-section with one flange vertical and the other flange horizontal. The horizontal flange carries the vertical opening to receive a padlock.

As seen, for example, in FIG. 14, the locking bar 22 has a vertical extent which is not greater than the vertical extent of the crossbeam 20 such that with the locking bar 22 itself doe not interfere with movement of the drawers 60 on either side of the crossbeam 20 to an open extended position.

FIG. 23 is a cross-sectional view along section line A-A of FIG. 22 showing a preferred configuration by which the locking bar 22 is pivotally mounted to the crossbeam 20 for pivoting about pivot axis 26. The locking bar 22 is L-shaped is cross-section having vertical leg 40 and horizontal leg 41. The crossbeam 20 has a vertical portion 61 presenting a forward face 62. A top flange 63 and a bottom flange 64 extending rearwardly from the vertical portion 61. At the location of pivot axis 26, a strengthening plate 66 is secured to the rear of the vertical portion 61. A screw 65 carrying washers 67 and 68 extends through an aperture the plate 66 and the vertical portion 61 and into a threaded nut 69 welded to a rear of the vertical leg 40 of the locking bar 22. The screw 65 serves to secure the locking bar 22 to the crossbeam 20 against removal from the crossbeam 20 in normal use. This has the advantage that with the locking bar secured to the crossbeam 20, the locking bar is always secured to the cabinet and cannot be removed or lost.

In all of the embodiments illustrated, the lock bar is preferably secured to the crossbeam 20 against removal from the crossbeam as is advantageous such that the crossbeam is always available and ready for use. The arrangement of the crossbeam of course permits movement of the crossbeam as by pivoting and/or sliding relative to the crossbeam 20 to provide for movement of the locking plates between the blocked and unblocked positions.

The figures show a filing cabinet with a crossbeam 20 which is preferred but not necessary. The sliding locking bar 22 of FIG. 1 could be mounted to one or both of the gable-like crossbeams 95 and 96 forward as part of and adjacent top wall 10 and bottom wall 56.

The continuous hinges forming the blocking plates 16, 17 are shown in each embodiment to extend the entire height of the cabinet 10. This is not necessary but preferred. The hinges need to only extend adjacent a portion of each drawer 60 whose opening is to be blocked.

Although this disclosure has described and illustrated preferred embodiments of the invention, it is to be understood that the invention is not restricted to these particular embodiments. Rather, the invention includes all embodiments that are functional or mechanical equivalents of the specific embodiments and features that have been described and illustrated herein. Many modifications and variations will now occur to those skilled in the art. For a definition of the invention, reference is made to the following claims.

We claim:

1. A filing cabinet comprising:

a framework having two opposite side walls, a top wall and a bottom wall defining a compartment therein having a forward opening;

at least one drawer slidably mounted in said compartment for sliding between a withdrawn position inside the compartment and an extended position in which the drawer extends forwardly out of the opening;

a right blocking plate hinged to the frame work on a right side of the opening and a left blocking plate hinged to the framework on a left side of the opening opposite to the right side of said opening, wherein each of said blocking plates is pivotable on a respective vertical axis between: (i) a blocked position in the path of the drawer forward of the drawer to prevent the drawer from forward movement from the retracted position; (ii) an unblocked position out of the path of the drawer to permit forward movement of the drawer from the retracted position to the extended position;

the framework including a horizontal crossbeam which has ends that are secured to said two opposite side walls proximate the forward opening;

a locking bar comprising a rigid unitary element having a right hand end and a left hand end, the locking bar mounted to said crossbeam of the framework against removal from the crossbeam and for horizontal sliding movement between, (i) a left most position in which the right side end of the locking bar is laterally inwardly of the right blocking plate such that the right blocking plate is free to be pivoted between the blocked and the unblocked positions and the left side end of the locking bar is in a position which is forward of the left blocking plate if the left blocking plate were in the blocked position preventing the left blocking plate from being pivoted between the blocked and the unblocked positions; (ii) a right most position in which the left side end of the locking bar is laterally inwardly of the left blocking plate such that the left blocking plate is free to be pivoted between the blocked and the unblocked positions and the right side of the locking bar is in a position which is forward of the right blocking plate if the right blocking plate were in the blocked position preventing the right blocking plate from being pivoted between the blocked and the unblocked positions; (iii) a center position in which the right side of the locking bar is in a position which is forward of the right blocking plate if the right blocking plate were in the blocked position preventing the right blocking plate from being pivoted between the blocked and the unblocked positions and the left side end of the locking bar is in a position which is forward of the left blocking plate if the left blocking plate were in the blocked position preventing the left blocking plate from being pivoted between the blocked and the unblocked positions, a locking mechanism to releasably lock the locking bar in the center position, wherein with the drawer in the retracted position and the locking bar in the center position with the left blocking plate in the blocked position and the right blocking plate in the blocked position, the drawer is prevented from forward movement from the retracted position, and wherein with the locking bar in the center position with the left blocking plate in the unblocked position and the right blocking plate in the unblocked position, the drawer is movable between the retracted position and the extended position.

2. A filing cabinet according to claim 1, wherein said crossbeam has a forward facing surface and said locking bar is mounted to said forward facing surface of said crossbeam.

3. A filing cabinet according to claim 2, wherein said two opposite side walls each have a forward facing gable surface, wherein a continuous hinge having a first hinge plate and a second hinge plate pivotable about a hinge pin has the first hinge plate mounted to said forward facing gable surface of said side wall and wherein the second hinge plate comprises one of said blocking plates, the continuous hinge extending vertically adjacent each drawer whose opening is to be blocked.

4. A filing cabinet according to claim 3, wherein in sliding between the leftmost position and the rightmost position the locking bar does not extend laterally farther than either of the side walls.

5. A filing cabinet according to claim 2, wherein in sliding between the leftmost position and the rightmost position the locking bar does not extend laterally farther than either of the side walls.

6. A filing cabinet according to claim 1, wherein said two opposite side walls each have a forward facing gable surface, wherein a continuous hinge having a first hinge plate and a second hinge plate pivotable about a hinge pin has the first hinge plate mounted to said forward facing gable surface of said side wall and wherein the second hinge plate comprises one of said blocking plates, the continuous hinge extending vertically adjacent each drawer whose opening is to be blocked.

7. A filing cabinet according to claim 6, wherein in sliding between the leftmost position and the rightmost position the locking bar does not extend laterally farther than either of the side walls.

8. A filing cabinet according to claim 1, wherein in sliding between the leftmost position and the rightmost position the locking bar does not extend laterally farther than either of the side walls.

* * * * *